US008979303B2

(12) United States Patent
Adams

(10) Patent No.: US 8,979,303 B2
(45) Date of Patent: Mar. 17, 2015

(54) LIGHT FIXTURE WITH CURVED FRAME

(71) Applicant: JST Performance, Inc., Mesa, AZ (US)

(72) Inventor: Stephen P. Adams, Mesa, AZ (US)

(73) Assignee: JST Performance, Inc., Gilbert, AZ (US)

( * ) Notice: Subject to any disclaimer, the term of this patent is extended or adjusted under 35 U.S.C. 154(b) by 0 days.

(21) Appl. No.: 13/741,307

(22) Filed: Jan. 14, 2013

(65) Prior Publication Data

US 2014/0016313 A1 Jan. 16, 2014

Related U.S. Application Data

(60) Provisional application No. 61/586,614, filed on Jan. 13, 2012.

(51) Int. Cl.

| | |
|---|---|
| ***F21V 1/00*** | (2006.01) |
| ***F21K 99/00*** | (2010.01) |
| ***F21V 15/01*** | (2006.01) |
| ***F21S 8/10*** | (2006.01) |
| *F21Y 101/02* | (2006.01) |

(52) U.S. Cl.

CPC ..... *F21K 9/30* (2013.01); *F21V 15/013* (2013.01); *F21Y 2101/02* (2013.01); *F21S 48/321* (2013.01); *F21S 48/328* (2013.01); *F21V 29/507* (2015.01); *F21V 29/75* (2015.01); *F21V 29/76* (2015.01)

USPC ..... 362/235; 362/294

(58) Field of Classification Search

CPC ..... F21V 29/2243; F21V 29/2262; F21V 15/011; F21V 5/013; F21V 2101/02; F21S 48/00; F21K 99/00

USPC ..... 362/235, 249.01, 249.02, 294, 373, 362/218, 345

See application file for complete search history.

(56) References Cited

U.S. PATENT DOCUMENTS

| | | | | |
|---|---|---|---|---|
| 6,561,690 | B2 * | 5/2003 | Balestriero et al. | 362/555 |
| 6,592,238 | B2 * | 7/2003 | Cleaver et al. | 362/246 |
| 7,217,004 | B2 * | 5/2007 | Park et al. | 362/240 |
| 7,695,164 | B2 * | 4/2010 | Berben et al. | 362/307 |
| 7,726,845 | B2 * | 6/2010 | Zheng et al. | 362/294 |
| 7,758,211 | B2 * | 7/2010 | Zheng et al. | 362/249.02 |
| 8,220,976 | B2 * | 7/2012 | Liu et al. | 362/373 |
| 8,246,219 | B2 * | 8/2012 | Teng et al. | 362/311.03 |
| 8,317,369 | B2 * | 11/2012 | McCanless | 362/368 |
| 8,591,057 | B2 * | 11/2013 | Kawabata et al. | 362/217.02 |
| 2009/0323342 | A1 * | 12/2009 | Liu | 362/249.02 |
| 2010/0091507 | A1 * | 4/2010 | Li et al. | 362/470 |

* cited by examiner

*Primary Examiner* — John A Ward

(57) ABSTRACT

A lighting fixture for protecting and mounting an array of light sources such as LED modules. The fixture includes a frame with a first surface that arcs or curves with an arc angle of between ten and fifty degrees and an arc length of between about ten to fifteen times the arc height. A plurality of LED modules including a lens and bonnet reflector are each functionally coupled against the first surface to direct a combination refracted and reflected beam pattern, the beam pattern of each LED module having an peak luminous intensity directed substantially normally from the first surface in front of and against which each LED module is functionally coupled. The peak luminous intensity of the combination refracted and reflected beam pattern associated with each LED module has a positive angle with respect to the combination refracted and reflected beam pattern from adjacently located LED modules.

19 Claims, 2 Drawing Sheets

LIGHT FIXTURE WITH CURVED FRAME

The application claims the benefit of U.S. Provisional Application No. 61/586,614 filed Jan. 13, 2012.

BACKGROUND OF THE INVENTION

1. Field of the Invention

The present invention relates to exterior vehicle lighting.

2. Discussion of the Prior Art

Prior art exterior vehicle lighting is limited in the manner by which light is distributed from the light source. For example, one prior art light source comprises one or more lights oriented in a plane and directing light in one direction and relying on diffusers or lenses to distribute light in directions other than the one direction. Based on the above limitations of the prior art, it would be preferable to improve the distribution of light.

SUMMARY OF THE INVENTION

It is an object of the invention to provide a lighting fixture for protecting and mounting an array of light sources such as Light Emitting Diode (LED) modules. The fixture includes a frame with a first surface that arcs or curves with an arc angle of between ten and fifty degrees and an arc length of between about ten to fifteen times the arc height. A plurality of LED modules including a lens and bonnet reflector are each functionally coupled against the first surface to direct a combination refracted and reflected beam pattern, the beam pattern of each LED module having an peak luminous intensity directed substantially normally from the first surface in front of and against which each LED module is functionally coupled. The peak luminous intensity of the combination refracted and reflected beam pattern associated with each LED module has a positive angle with respect to the combination refracted and reflected beam pattern from adjacently located LED modules.

The light fixture of the current invention fulfills the objective of producing a plurality of combination refracted and reflected beam patterns associated with each LED module and wherein each of the combination refracted and reflected beam patterns is directed substantially normal to the first surface of the frame behind and adjacent to each LED module. The resulting composite beam pattern comprised of the combination refracted and reflected beam pattern has a substantially uniform luminous intensity at angles within the arc angle of the fixture.

Objectives are fulfilled by the invention including the enhanced distribution of light from a combination beam light source without having to use a diffuser or a lens shape that also diminishes the intensity or brightness of a light source as it spreads or distributes light. Accordingly, the present invention is particularly useful in as a spot light that distributes with equal intensity in a radial pattern.

DESCRIPTION OF THE INVENTION AND/OR EMBODIMENTS

Figure 1:
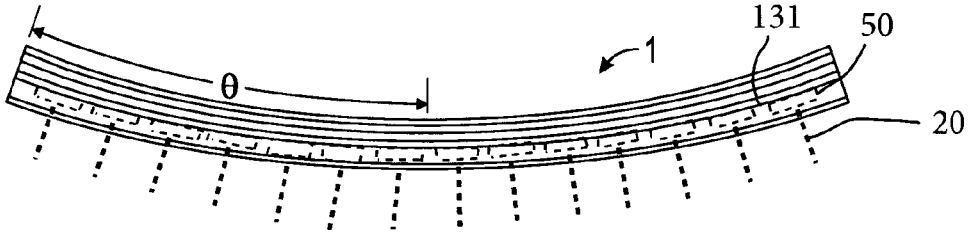
FIG. 1 illustrates a top view of an embodiment of the invention.

The invention comprises a curved frame for use as a lighting fixture for protecting and mounting a plurality of light sources on a vehicle or other transportation. FIG. 1 is a top view of a preferred curvature or arc angle "Θ" of the frame 1. An exemplary light source using the frame 1 includes an array of distinct light sources such as LED modules 50 oriented to direct and distribute light 20 radially in a semi-circumferential pattern from the frame 1 in the direction of the arc. The LED modules 50 may include at least one LED and at least one other LED module component such as a reflector, an LED driver, an LED lens, or an LED housing. A plurality of thermal fins 11 extend from the back of the curved backplane 131 to dissipate heat from the electronics within the frame 1.

Figure 2:
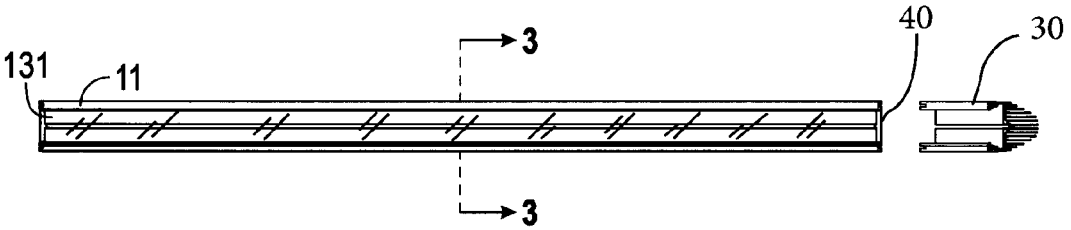
FIG. 2 illustrates a front view with a cutaway portion.

The frame 1 provides both structural support for the LED modules and thermal management. A preferred electronics frame is composed of metal and has a first side with a substantially smooth or planar surface and a second side with fins 111 for heat dissipation. FIG. 2 illustrates a front view of the frame 1 and the interior surface or curved backplane 131 against which the LED modules are coupled. LED modules are arranged in an array comprising one or more rows of LED modules coupled against the curved backplane 131.

Figure 3:
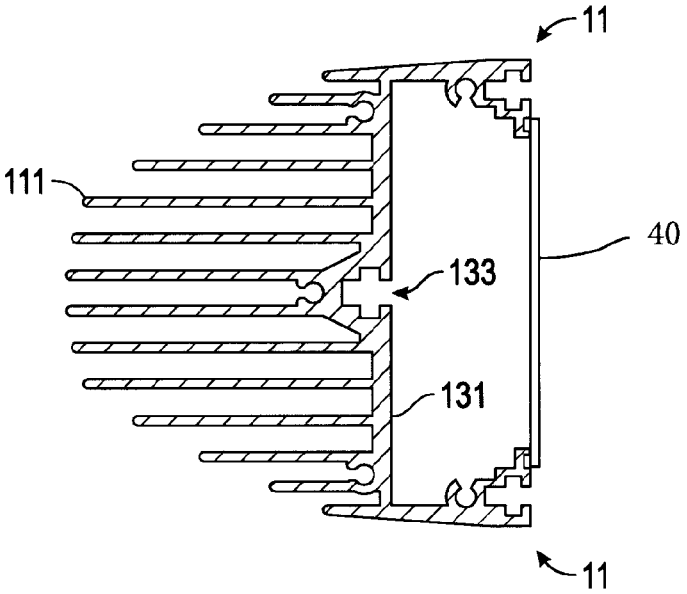
FIG. 3 illustrates a cross section.

FIG. 3 illustrates a cross section of the curved frame 1. A curved perimeter ridge 11 extends from either side of the curved backplane 131 for the length of the frame 1 and provides a cavity, channel or recess within which the LED modules are secured and protected. A protective lens (not shown) constructed from a sturdy and abrasion resistant material such as polycarbonate is mechanically coupled to the perimeter ridge 11 and defines a cavity within which the LED control electronics are secured and sets the lens off from the curved frame 1 and the LED modules within cavity defined by the curved backplane 131 and the curved perimeter ridge 11. The protective lens can be either clear or incorporate one or more lens designs to focus or collimate or diffuse or direct light in a desired direction from the frame 1.

The preferred curved backplane 131 includes a backplane trough 133 defined by at least one surface separated from, and substantially parallel to, the curved backplane 131 surface. The illustrated trough 133 is equidistant from either perimeter ridge 11 but can be offset from the center. The at least one surface of the backplane trough 133 is a biasing surface against which fasteners can bias for securing LED modules or circuit boards to the backplane 131. As illustrated in FIG. 3, the preferred backplane trough 133 as viewed from a cross section resembles a negative image of a "+" or "t" shape and comprises five surfaces substantially parallel to the curved backplane 111 and six surfaces substantially perpendicular to the curved backplane 131. Nut-type fasteners are slid into the trough from the ends of the frame 1 and oriented to be engaged by bolt or screw type fasteners from a direction substantially perpendicularly to the backplane 131 and engage and bias to secure circuit boards placed against the backplane 111.

Figure 4:
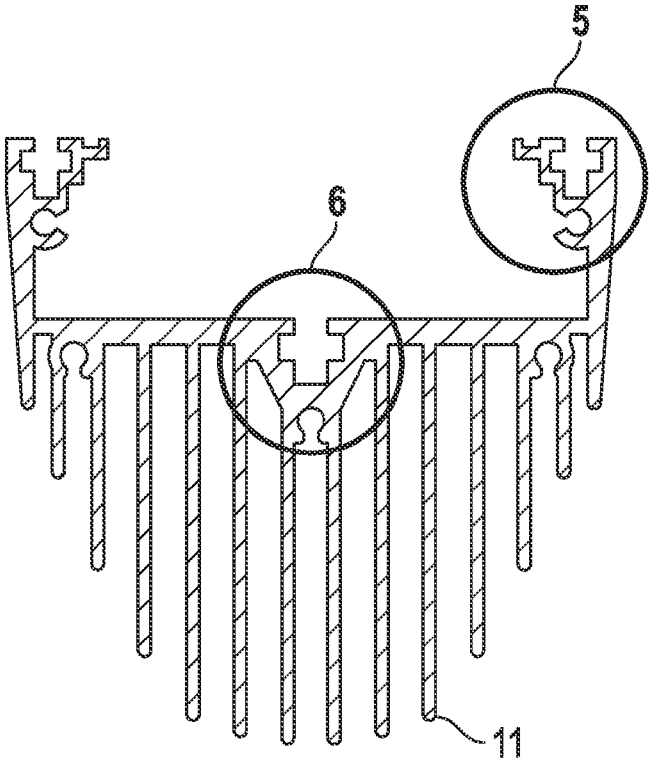
FIG. 4 illustrates a cross section with portions specified for detail in FIGS. 5 & 6.
Figure 5:
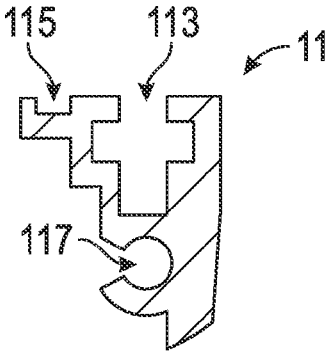
FIG. 5 illustrates detail from the perimeter ridge 11.
Figure 6:
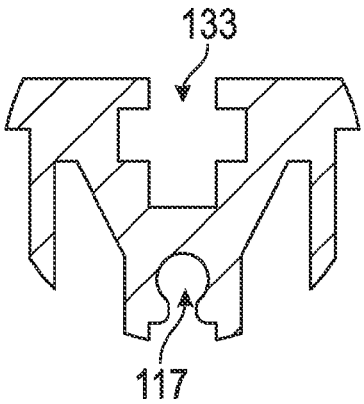
FIG. 6 illustrates detail from the backplane trough 133, respectively.

As illustrated in the cross sectional view of FIG. 4, the perimeter ridge 11 has a ridge height or longitudinal dimension between about one-half and one-fourth, and preferably about one-third of the height of the frame 1. A perimeter trough 113 is accessible beneath the top edge(s) of the perimeter ridge 11. As cross section of the perimeter trough 113 illustrated in FIG. 5 resembles a negative image of a "+" or "t" shape with five surfaces substantially parallel to the curved backplane 111 or top edge of the perimeter ridge 11 and six surfaces substantially perpendicular to the curved backplane 131 and top edges of the perimeter ridge 11. The preferred perimeter ridge 11 includes an O-ring channel 115 extending substantially perpendicularly from the perimeter ridge 11 towards the interior of the frame 1 and positioned adjacent the top edge of the perimeter ridge 11. The channel or trough 115 is adapted or sized to receive a rubber gasket or O-ring, which is compressed by the fixture lens mechanically coupled to the perimeter ridge 11 top edges by fasteners biased by the perimeter trough 113.

In one example of use, a plurality of LED modules are securable to the backplane 131 in equal or unequal rows, with equal or unequal numbers of LED modules. In this example, the LED modules each include an LED with encapsulate to refract light into a lambertion pattern and may optionally include a lens suspended above or adhered to the encapsulate to refract light into a refracted beam pattern. A bonnet type reflector is positioned adjacently and above each LED creating a reflected beam into a reflected beam pattern. The bonnet type reflector is a curved concave shape and may be any shape that reflects light into a reflected beam pattern. The combination of the refracted beam pattern and reflected beam pattern from each LED module produces a combination refracted and reflected beam pattern directed away and substantially normally from the curved backplane 131 above or adjacent to which the LED module is positioned and secured. The plurality of LED modules produce a plurality of combination refracted and reflected beam patterns wherein each of the plurality of combination beam patterns is directed substantially normally from the curved backplane 111 above which each LED module is positioned and secured.

In another example, the plurality of LED modules omits either or both of the refracting lens or the reflecting lens. Still, the production of a plurality of beam patterns from each LED module is directed substantially normally to the backplane 131 to produce a light direction pattern correlated with the curvature of the backplane 131 of the frame 1. The beam pattern associated with each LED module creates a positive angle with respect to the beam pattern associated with LED modules adjacently located on the backplane 131. As a result, the light emitted from each LED module is cast at a positive angle with respect to the light emitted from adjacently located LED modules and the luminous intensity of light emitted from the frame 1 is substantially equivalent within the arc angle of the frame 1. The composite beam from the LED has a substantially consistent luminous intensity within the arc angle of the frame 1 as compared relative to a light fixture having a non-curved or substantially linear light fixture.

The illustrated frame 1 of FIG. 1 has a preferred arc angle "Θ" of between twenty degrees) (20°) and forty five degrees (45°) and is preferably about thirty six degrees (36°) from one end of the frame 1 to the other. The frame 1 arc length is between about ten to fifteen times the arc height and preferably about twelve to thirteen times the arc height.

The electronics frame may be a die cast, die cast module, or made by extruding a radius light having the arc angle desired or extruding a straight or linear metal electronics frame, notching the fins in one or more places (to deter buckling of the metal fins), and bending or curving the frame to the desired curvature. Whether extruded or molded another preferred manner of constructing the frame 1 is by molding or extruding identical frame 1 segments having a curved dimension which are then fastened or secured together at the ends to create a completed frame 1 with the desired frame length and arc angle.

End caps 30 are secured to the ends of the frame 1 by inserting fasteners such as screws or bolts through the end caps 30 and into fastener receptacles 117 such as screw holes or threaded bolt apertures. The illustrated embodiment shows the fastener receptacles 117 positioned substantially directly beneath the backplane trough 133 and the perimeter trough 113. The end caps 30 are a unitary construction that are secured to the frame 1 ends include a mounting pivot such as a bolt extending substantially laterally from the frame and provide a mounting point for coupling the frame 1 to mounting hardware and access for the electrical conductor providing power to the interior of the fixture. To enclose the fixture, the end caps 30 are secured to the frame 1 and the protective lens 40 positioned across the frame 1. A plurality of longitudinally dimensioned rails (not shown) having a width substantially equivalent to the perimeter ridge are placed on top of the fixture lens and bolt type fasteners inserted into nuts positioned laterally in the perimeter trough 113 to engage the bolt type fasteners.

While various embodiments have been described above, it should be understood that they have been presented by way of example only, and not limitation. Thus, the breadth and scope of a preferred embodiment should not be limited by any of the above-described exemplary embodiments, but should be defined only in accordance with the following claims and their equivalents.

What is claimed is:

1. A lighting fixture for protecting and mounting an array of LED modules, comprising:

a frame with a first surface having an arc angle of between ten and fifty degrees and an arc length of between about ten to fifteen times an arc height; and a plurality of light sources functionally coupled against the first surface to direct a peak luminous intensity of each light source substantially normally away from the first surface against which each light source is functionally coupled, the peak luminous intensity of each of the plurality of light sources having a positive angle with respect to the peak luminous intensity from adjacently located light sources.

2. The lighting fixture in claim 1, wherein the arc angle is about thirty six degrees and the arc length is about twelve to thirteen times the arc height.

3. The lighting fixture in claim 2 wherein, the frame includes a perimeter ridge wherein the cross section of the perimeter ridge has a height of between about one-half and one-fourth of the width of the frame.

4. The lighting fixture in claim 3, wherein, the perimeter ridge includes a perimeter trough at the top interior edge of the perimeter ridge.

5. The lighting fixture in claim 4, wherein, the perimeter trough has five surfaces substantially parallel to the first surface and six surfaces substantially perpendicular to the first surface.

6. The lighting fixture in claim 5 further comprising, a channel sized to receive an O-ring, said channel extending from the top edge of the perimeter ridge towards the interior of the frame.

7. The lighting fixture in claim 1 wherein, the first surface includes a trough having at least one surface separated from, and substantially parallel to, the first surface.

8. The lighting fixture in claim 7 wherein, the trough comprises at least one biasing surface against which fasteners bias for securing circuit boards to the first surface.

9. The lighting fixture in claim 8 wherein, the trough has five surfaces substantially parallel to the first surface and six surfaces substantially perpendicular to the first surface.

10. The lighting fixture in claim 9 wherein, the trough cross section resembles a negative image of a "+" shape.

11. The lighting fixture in claim 1 wherein, a plurality of thermal fins extend rearward from the frame in the opposite direction from, and substantially normal to, the first surface.

12. The lighting fixture in claim 11, wherein a cross section of the furthest rearward edges of the thermal fins have a convex pattern.

13. The lighting fixture in claim 1, wherein the plurality of light sources comprises a plurality of LED modules including a lens positioned to create a refracted beam pattern.

14. The lighting fixture in claim 1, wherein the plurality of light sources comprises a plurality of LED modules having a bonnet reflector to create a reflected beam pattern.

15. The lighting fixture in claim 1, wherein the plurality of light sources comprises a plurality of LED modules including a lens positioned to create a refracted beam pattern and a bonnet reflector to create a reflected beam pattern.

16. A lighting fixture for protecting and mounting an array of LED modules, comprising:

a frame having two ends and a first surface having an arc angle of between ten and fifty degrees and an arc length of between about ten to fifteen times an arc height; and a plurality of light sources functionally coupled against the first surface to direct a peak luminous intensity of each light source substantially normally away from the first surface against which each light source is functionally coupled, the peak luminous intensity of each of the plurality of light sources having a positive angle with respect to the peak luminous intensity from adjacently located light sources.

17. The lighting fixture of claim 16, wherein the two ends of the frame include fastener receptacles consisting of a receptacle selected from bolt or screw holes.

18. The lighting fixture of claim 17, further comprising end caps having mounting pivots secured to the two ends, the end caps having a mounting pivot bolt extending substantially laterally from the frame.

19. The lighting fixture of claim 16, wherein the frame comprises a plurality of die cast or extruded modules joined at the ends to produce the arc angle of between ten and fifty degrees and an arc length of between about ten to fifteen times the arc height.

* * * * *